United States Patent [19]

Norman et al.

[11] 4,188,204

[45] Feb. 12, 1980

[54] METALLURGICAL PROCESS USING LIQUID FUELS

[75] Inventors: James L. Norman; Donald J. Mayhall, both of Houston, Tex.

[73] Assignee: Falconbridge Nickel Mines Limited, Toronto, Canada

[21] Appl. No.: 9,880

[22] Filed: Feb. 6, 1979

[51] Int. Cl.[2] ..... C22D 7/06

[52] U.S. Cl. ..... 75/11; 75/21; 75/82; 75/133.5

[58] Field of Search ..... 75/10, 11, 21, 82, 133.5

[56] References Cited

U.S. PATENT DOCUMENTS

| | | | |
|---|---|---|---|
| 3,272,616 | 9/1966 | Queneau | 75/82 |
| 3,870,063 | 3/1975 | Hayward | 48/190 X |

*Primary Examiner*—M. J. Andrews

*Attorney, Agent, or Firm*—Lowe, King, Price & Becker

[57] ABSTRACT

A lateritic ore reduction process wherein a light, low sulphur-containing naphtha is employed to produce a pre-reduced calcine and a heavy residual fuel is utilized to provide the energy to subsequently melt the calcine, and wherein both operations are carried out at a location remote from a source of the fuels required. Two different fuels are mixed at the source to form a blend, which is pumped, at ambient temperature, through a single pipeline to the ore reduction plant. The blend is fractionated into two products required for two or more operations in the ore treatment, and the two product fuels are consumed substantially in their entirety in the respective operations.

5 Claims, 1 Drawing Figure

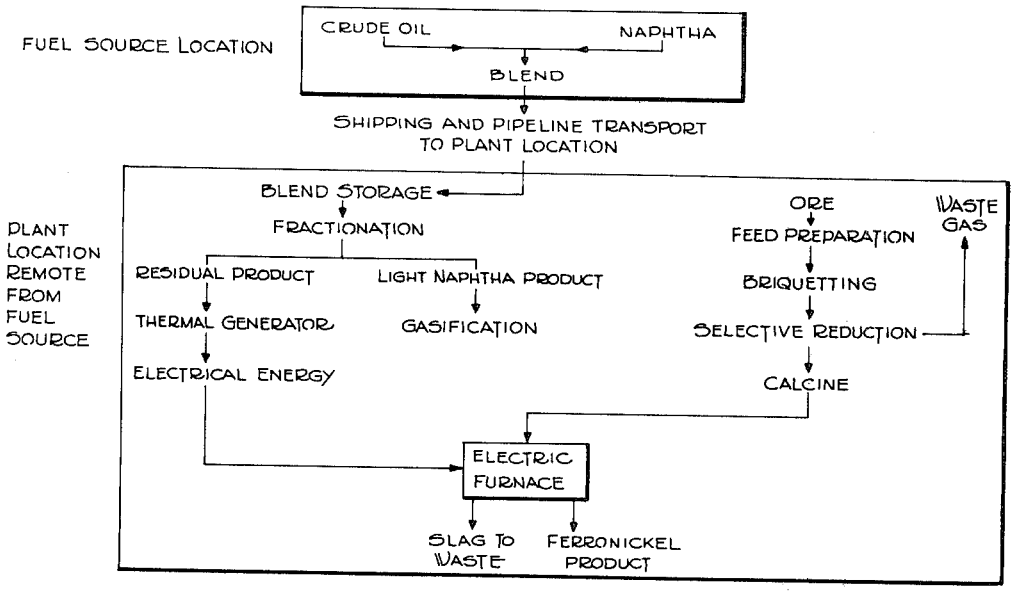

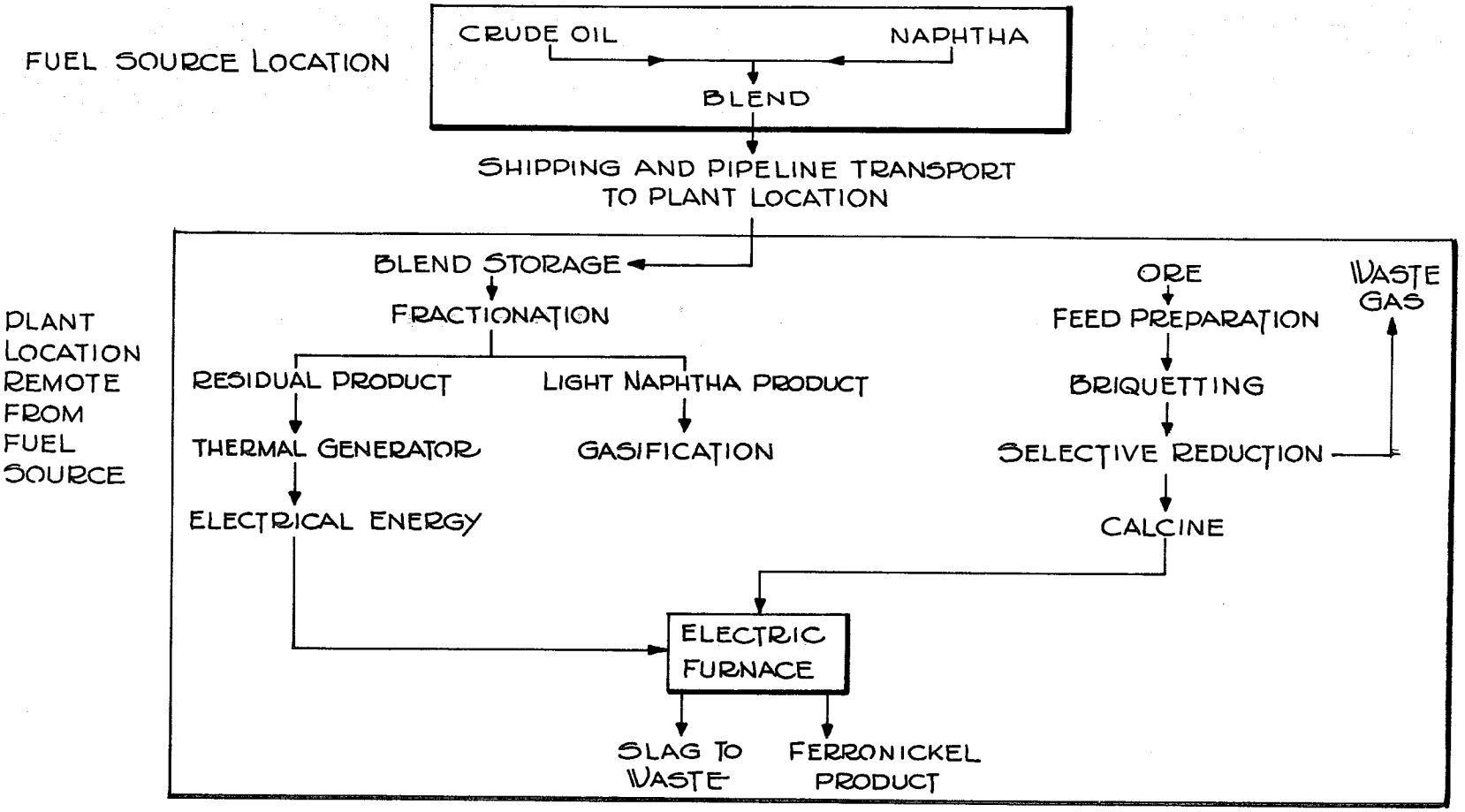
FUEL SOURCE LOCATION
CRUDE OIL
NAPHTHA
BLEND
SHIPPING AND PIPELINE TRANSPORT TO PLANT LOCATION
PLANT LOCATION REMOTE FROM FUEL SOURCE
BLEND STORAGE
FRACTIONATION
RESIDUAL PRODUCT
LIGHT NAPHTHA PRODUCT
THERMAL GENERATOR
GASIFICATION
ELECTRICAL ENERGY
ORE
FEED PREPARATION
BRIQUETTING
SELECTIVE REDUCTION
WASTE GAS
CALCINE
ELECTRIC FURNACE
FERRONICKEL PRODUCT
SLAG TO WASTE

METALLURGICAL PROCESS USING LIQUID FUELS

This invention relates to the production of ferronickel from lateritic ores using more than one liquid fuel at a location remote from a source of such fuels.

Metallurgical plants are frequently located at sites distant from a source of liquid fuels. It is well known that for overland distances greater than a few miles, pipelines are the preferred means for transporting liquid fuels. Unfortunately, the provision of individual conduits for conveying each fuel places a huge economic burden on the overall metallurgical process. Indeed, to select but one characteristic of the fuels, in the case of very viscous liquids, the pumping costs may be so high as to preclude their use in a remote ore reduction plant even though they may be metallurgically desirable in a more accessible location.

The metallurgical process described hereinafter utilizes more than one type of liquid fuel and the properties of each are dictated by the requirements of the individual steps comprising the ore treatment. For instance, a relatively inexpensive fuel may be used for power generation, while a more costly liquid fuel with more restricted range in sulphur content, boiling point and viscosity may be required for a specific reductive process. The fuels utilized often differ in their respective flow properties and compositions, but being essentially hydrocarbons, they can be blended and transported to the remote location of the reduction process by a single pipeline.

As far as is known, there is no prior art that teaches a general solution to the problem of providing liquid fuels for remotely-located metallurgical plants. Methods are known which focus on the narrower problem of merely transporting high viscosity fuels from one location to another but such are insufficient for present purposes. For example, U.S. Pat. No. 3,870,063 describes a process in which a viscous hydrocarbon, not normally pumpable at ambient temperature, is diluted with a light petroleum distillate to generate a blend which can be pumped. It is taught, however, that the diluent must be recovered by distillation from the blend after pipelining and recycled, via a second pipeline, for further blending with the viscous fuel. This art, therefore, fails to remove the economic objection of multiple pipelines for multiple fuels.

Iron ore is reduced to crude iron in a process described in U.S. Pat. Nos. 3,985,544 and 4,094,665, wherein the energy obtained by combustion of fine coal particles is utilized in both stages of the process. The fluid bed furnace which is incorporated in the process taught by this prior art can, however, only operate with fairly high grade iron ore, and its use in reducing lateritic ores would be fraught with difficulties. The conversion to electric power of the thermal energy of the fuel utilized by the process described requires an elaborate and costly heat exchanger system. Thus the method taught by this prior art would not be applicable in the reduction of lateritic ores by liquid fuels.

An object of the present invention is, therefore, to provide fuels for a metallurgical process comprising furnacing lateritic nickel ores for the recovery of ferronickel, which utilizes heavy as well as light hydrocarbon fuels with different sulphur contents, at a location remote from the source of such fuels.

Thus, by one aspect of this invention there is provided a process comprising, blending a heavy crude oil with naphtha to form a blend pumpable at ambient temperature, transporting the blend between the source and the remote location by pumping in a pipeline at ambient temperature, fractionating the blend at the remote location in order to recover a light, low-sulphur naphtha product, and a heavy, high-sulphur residual product, partially combusting the naphtha product with air to form a hot reducing gas, contacting the ore with the gas to form a hot, selectively reduced calcine, using the heavy high sulphur residual product for thermally generating electrical energy, which is subsequently used to melt the calcine to form a substantially barren slag underlain by a layer of molten ferronickel, and separating the ferronickel from the slag.

The FIGURE shows a schematic flowsheet describing the steps embodying the present invention.

The lateritic ore treatment shown in the FIGURE, and incorporating at least two operations utilizing liquid fuels, is related to the recovery of ferronickel from lateritic ores as already disclosed in U.S. Pat. No. 3,535,105. One such metallurgical plant presently in operation using the process of U.S. Pat. No. 3,535,105 is located in the Republic of Dominica near the ore body and at a considerable distance inland from the nearest port, to which the liquid fuels are delivered by ship and thence they must be transported by some other means. According to the present invention the means of transport to the plant is a pipeline and thus the source of the liquid fuels may be defined for purposes of the present specification to be the blending station, wherefrom the fuels are shipped to the end of the pipeline that is remote from the plant. In any case it can be said in general that the plant is connected to the source of the fuels by means of a pipeline.

In one of the operations incorporated in the process for recovering ferronickel from lateritic ores, electric power is generated by combusting heavy residual fuels, which are so viscous that they could only be pumped at ambient temperature with considerable difficulty and cost. In another operation in the treatment of lateritic ores, a light hydrocarbon fuel of low boiling range, and of low sulphur content, generally known as naphtha, is volatilized and is combusted to provide gases for the selective reduction of the ore. The fuels, which are of similar boiling ranges to those utilized in the various steps of the ore treatment process at the plant, are mixed or blended at the source, or at the end of the pipeline remote from the plant to form a homogeneous blend, and the blend is transported to the plant through a single pipeline at the ambient temperatures which normally pertain in that geographical region and without auxiliary heating. The fuels blended at the source are usually, but not necessarily, crude oil and naphtha. The blend reaching the plant is then fractionated, and the hydrocarbon products obtained are, substantially in their entirety, consumed in the respective metallurgical operations. It frequently occurs that the light fraction obtained from the blend by fractionation has increased in volume over that of the naphtha admixed at the source, by additionally extracting some of the lighter hydrocarbons contained in the crude oil component, through distillation. The only constraint on the compositions or quantities of the fuels that are mixed, is that the resulting blend will yield, upon subsequent fractionation at the plant, the different fuels needed or desired for the process, and in the required quantities.

In the selective reduction operation, shown in the FIGURE lateritic ore briquettes, containing about 1.5% nickel are reduced in a shaft furnace by gases resulting from the partial combustion of a low-sulphur liquid fuel. Nickel in the ore is reduced, along with an approximately equivalent amount of iron, to form a calcine containing metallic ferronickel. The chemistry of this operation is such that any sulphur present in the fuel is largely transferred to the metallic phase, from which it can be removed only at additional expense. Consequently, the liquid fuel used for the reduction advantageously has a low sulphur content, less than about 1800 ppm, and preferably less than 100 ppm, and for this application a particularly preferred fuel is a light, low boiling point, low sulphur containing fraction which falls in the category commonly known as naphtha.

An electric furnace is used to separate the ferronickel from the calcined, selectively reduced ore, the bulk of which is removed as slag, and the metallic phase collects as a molten pool in the furnace bottom. In the absence of hydroelectric power, power for the electric furnaces is generated thermally by combusting a heavy residual liquid fuel. Since the sulphur requirements of fuels for power generation are generally considerably less stringent than for the reduction operation described above, a cheaper metallurgical fuel is used. Typically the sulphur content of such fuels will be in the range of a few percent, but should not exceed 30,000 ppm since this can give rise to excessive sulphur dioxide emission from the power plant.

In the production of ferronickel according to the method described herein, it is usual but not essential, that the liquid-petroleum fuels which form the blend, have specifications such as those shown in Table 1.

TABLE 1

SPECIFICATIONS OF LIQUID FUELS BLENDED AT THE SOURCE FOR THE PRODUCTION OF FERRONICKEL

| | Naphtha | Crude Oil | Blend Obtained |
|---|---|---|---|
| API Gravity @ 60° F. | 57.0-59.6 | 11.9-12.1 | 28.0-30.0 |
| Relative Density @ 60° F. | 0.74 | 0.985 | 0.87 |
| Viscosity Saybolt @ 122° F. sec | — | 609 | — |
| Pour Point, °F. | — | 30 | 20 |
| Sulphur, ppm | 20-120 | 25000 -30000 | approx. 18,000 |

In this embodiment, the two fuels shown in Table 1 are combined at the source in a ratio of about 40:60 by volume of the light to the viscous fuel, which corresponds to the ratio of consumption of the two fuels obtained by fractionation in the ore reduction plant. It will be appreciated that different proportions would apply if other liquid-hydrocarbon fuels were used.

The blend is then transported by shipping and conventional pipelining from a blending station to the remote ore treatment plant as shown in the FIGURE. The pipeline is normally steel and pumping pressures of up to about 1500 psi are necessary to overcome the pressure drop of the pipeline over a distance of about 50 miles. For greater distances additional pumping stations are included in the system as required.

The homogeneous blend may be temporarily stored until it is fractionated to separate fuels at the ore treatment plant. The distillate obtained is a light, low-sulphur naphtha product, which is consumed in the selective ore reduction as described hereinabove. The heavy, residual product, with relatively high sulphur content, is used in the thermal power generation for the electric furnace operation. In Table II are listed the relevant properties of the liquid fuels recovered from the blended fuel by the fractionation.

TABLE II

FUEL SPECIFICATIONS IN THE PRODUCTION OF FERRONICKEL

| | Naphtha Product | Residual Product |
|---|---|---|
| API Gravity (60° F.) | 52.0-55.0 | 10.7-11.2 |
| Sulphur (ppm) | <1800 | >2000 |
| End-Point (°F.) | 560-595 | — |

In the embodiment described, it happens that the fuels obtained as naphtha and residual products respectively, at the metallurgical plant, resemble the liquid fuels that are used to make up the blend fed through the pipeline. It is to be stressed, however, that this need not necessarily be the case. Only two criteria limit the invention; firstly, the liquid fuels chosen for transport must form a pumpable blend at ambient temperature, and secondly, the blend must yield by fractionation products fuels of suitable compositions and in sufficient quantities to meet the requirements of the operations in which they are consumed at the metallurgical plant. Not all the naphtha product is necessarily consumed in the reduction operation alone; some of it may be used in other metallurgical operations at the plant, such as ore drying, for example.

As discussed hereinabove, the sulphur contained in the low viscosity naphtha product used in the ore reduction process, is nearly completely retained in the metallic fraction obtained from the ore, and may be detrimental to the final ferronickel produced. The cost of removal of sulphur from the metallurgical product is high, and it may be more advantageous and less costly to further lower the sulphur content of the low viscosity and low sulphur fraction by passage through a desulphurizing unit. The distillate described as naphtha in Table II would have the following typical characteristics after having been further desulphurized:

| | |
|---|---|
| API Gravity | 54.0-56.0 |
| Sulphur ppm | 20-30 |
| End Point (°F.) | 560-592 |

It should be emphasized that the main purpose of the processes described hereinabove is to provide liquid fuels for the different requirements of various operations in the metallurgical treatment of lateritic nickel ore. Hence all the fractions obtained from the blended liquid fuels are completely consumed at the metallurgical plant, so that there is no build-up of unused fractionated fuels, nor is there a fraction which is recycled through a second pipeline for blending with further quantities of fuel at the source.

The high efficiency of the method of the present invention will be appreciated by those skilled in the art. The method allows liquid fuels to be economically conveyed in a single pipeline because substantially all the resulting fuels are consumed at the plant. The absence of heating stations or pipeline recycle facilities in the method of the present invention makes for a significant simplification in the utilization of liquid fuels in ore treatments at locations remote from a source of the fuels.

We claim:

1. In a process for the recovery of ferronickel from lateritic nickel ores utilizing liquid hydrocarbons, at a location remote from a source of liquid hydrocarbons, the improvement comprising:

(i) blending heavy crude oil with naphtha to form a blend pumpable at ambient temperature;

(ii) transporting the blend between the source and the remote location by means which include pumping, at ambient temperature, through a pipeline;

(iii) fractionating the blend at the remote location to recover a light, low-sulphur naphtha product, and a heavy high-sulphur residual product;

(iv) partially combusting the naphtha product with air to form a hot reducing gas, and contacting the ore with the gas to obtain a hot, selectively reduced, calcine;

(v) using the heavy high-sulphur residual product for thermal generation of electrical energy;

(vi) using the electrical energy to melt the calcine to form a substantially barren slag underlain by a molten layer of ferronickel; and (vii) separating the ferronickel from the slag.

2. A method according to claim 1 in which the light low-sulphur naphtha product obtained includes hydrocarbons occurring in the crude oil, and is recovered in a quantity greater than the quantity of the naphtha blended.

3. A method according to claim 1 in which all the products obtained from the blend are utilized substantially in their entirety in the recovery of ferronickel.

4. A method according to claim 1 wherein the light, low-sulphur naphtha product has a sulphur content less than 1500 ppm, and the heavy high sulphur residual product has a sulphur content which is higher than 2000 ppm.

5. A method according to claim 4 wherein the sulphur content of the light low-sulphur naphtha product has been reduced to less than 100 ppm.

* * * * *